US005727436A

United States Patent [19]

Swedberg et al.

[11] Patent Number: 5,727,436

[45] Date of Patent: Mar. 17, 1998

[54] DRAW PUNCH HAVING RELIEVED HELICAL WORKING FACES

[75] Inventors: Benjamin D. Swedberg; Edwin R. Burgess, III, both of Sycamore, Ill.

[73] Assignee: Ideal Industries, Inc., Sycamore, Ill.

[21] Appl. No.: 411,414

[22] Filed: Mar. 27, 1995

[51] Int. Cl.[6] ..... B26F 1/14

[52] U.S. Cl. ..... 83/686; 83/689; 30/360; 30/361

[58] Field of Search ..... 83/686, 687, 688, 83/689, 681, 684, 685; 30/360, 361, 366, 367, 443, 446; 408/204, 211

[56] References Cited

U.S. PATENT DOCUMENTS

| | | | |
|---|---|---|---|
| 1,721,007 | 7/1929 | Doherty et al. | 30/360 |
| 1,817,223 | 8/1931 | Abramson et al. | 30/360 |
| 2,221,904 | 11/1940 | Abramson et al. | 30/360 |
| 2,237,069 | 4/1941 | Christenson | 30/360 |
| 3,228,268 | 1/1966 | Strout | 408/211 X |
| 3,683,499 | 8/1972 | Robinson, Jr. | 30/360 |
| 4,353,164 | 10/1982 | Linquist et al. | 30/360 |
| 4,543,722 | 10/1985 | Adleman et al. | 83/688 X |
| 4,739,687 | 4/1988 | Wanner et al. | 83/688 |
| 4,793,063 | 12/1988 | Ducret | 30/360 |
| 4,807,367 | 2/1989 | Loerwald | 30/367 X |
| 4,905,557 | 3/1990 | Adleman | 30/360 X |
| 5,029,392 | 7/1991 | Bingham et al. | 30/360 |
| 5,639,193 | 6/1997 | Anderson | 408/204 |

FOREIGN PATENT DOCUMENTS

| | | | |
|---|---|---|---|
| 931764 | 6/1963 | United Kingdom | 408/204 |

*Primary Examiner*—Clark F. Dexter

*Attorney, Agent, or Firm*—Dorn, McEachran, Jambor & Keating

[57] ABSTRACT

A draw punch of the type used for cutting holes in various materials such as sheet metal has a cylindrical body with a central bore through it and a cutting edge at the outside diameter of the body. A working face is defined at one end of the body between the cutting edge and the bore. The working face includes two diametral axial faces which extend from a root to a peak. The working face further includes two valleys located between the peak of one axial face and the root of the other axial face. Primary helical surfaces extend from a peak to a valley while secondary helical surfaces extend from the valley to the root. The helical surfaces are everywhere relieved in a radial direction from a plane normal to the axis of the body and intersecting any point on the cutting edge.

16 Claims, 2 Drawing Sheets

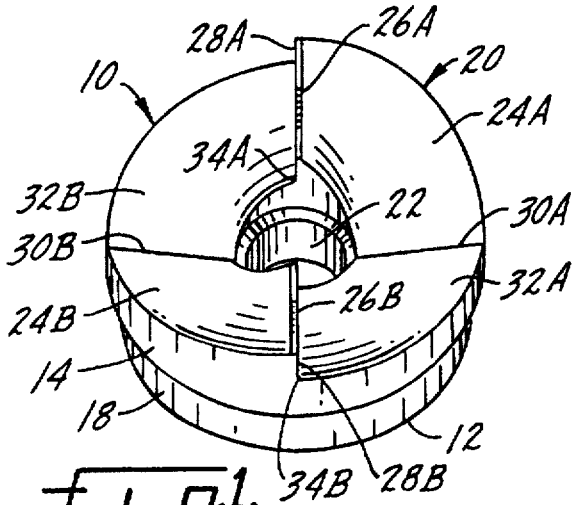
fig. 1.
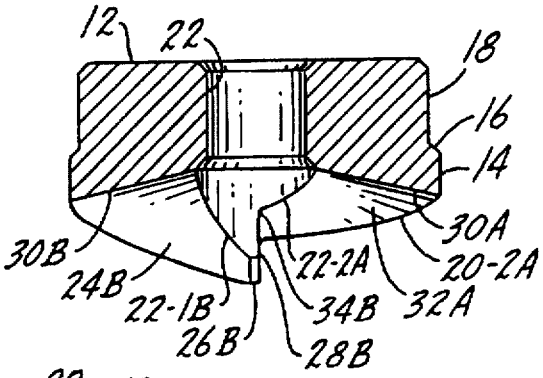
fig. 7.
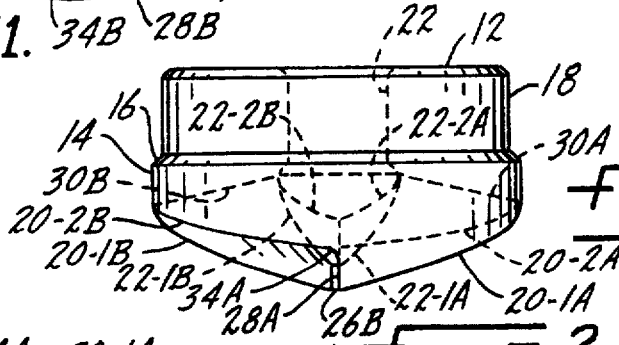
fig. 3.
fig. 2.
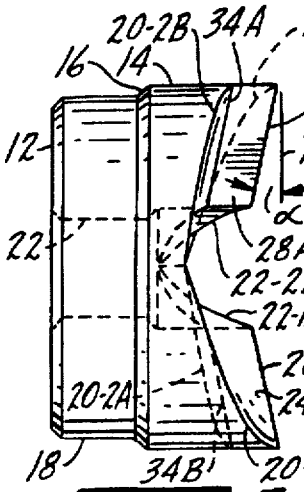
fig. 5.
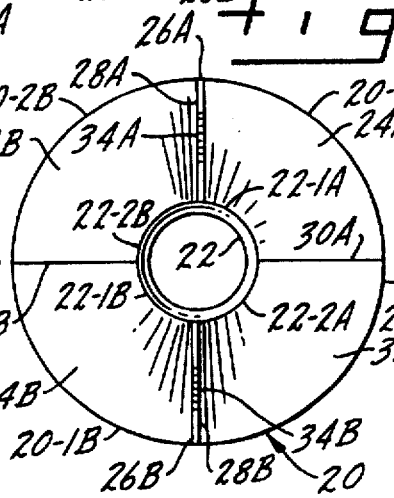
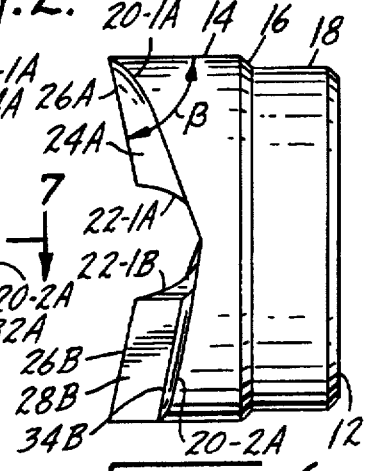
fig. 6.
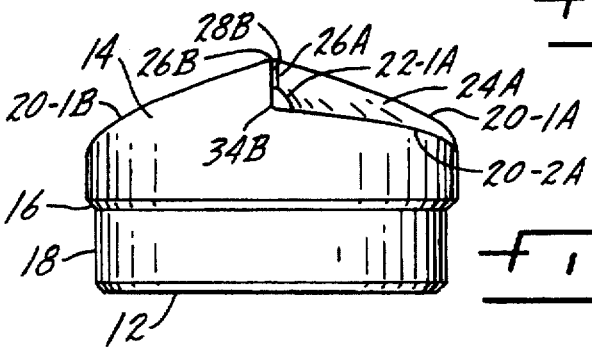
fig. 4.

DRAW PUNCH HAVING RELIEVED HELICAL WORKING FACES

BACKGROUND OF THE INVENTION

This invention relates to draw punches of the type used to cut holes in sheet metal and the like. Draw punches are used when holes are needed that cannot readily be made with a drill due to the size of the hole or limited access to the hole site. A typical application is the cutting of a hole in the wall of an electrical junction box, although the invention is not limited to such a use. Usually the hole is formed by drilling a small pilot hole through the sheet metal and placing a threaded stud or bolt through the pilot hole. The punch is attached to the bolt on one side of the sheet metal and a die is placed adjacent the sheet metal on the other side. A wrench or hydraulic driver is used to draw the punch through the metal and into the die. As it is drawn, the punch cuts a slug of metal which is usually round with a hole in the center.

One of the problems associated with this procedure is the tendency of the metal slug to bind in the die. When that happens the user has to remove the punch from the die and find a tool with which to pry the slug out of the die. At the very least this causes lost productivity as the worker has to take time to clear the die. In the process there is the danger of injuring the worker when prying tools or the slug suddenly slip out of the die. There is also a chance of damaging the tools used for prying as the worker, already disgusted that time must be wasted to clear the die, is likely to grab any tool at hand, whether it is appropriate for prying or not.

To overcome the binding problem it is known to configure the draw punch such that it will not only cut the slug out of the sheet metal but also split the slug into two pieces. That is, the slug is split along a diameter into two, generally C-shaped halves. Slug halves usually do not bind in the die so they can be removed by simply turning the die over and dumping the halves out. However, it has been found that in certain size holes with certain materials the C-shaped slug halves can bind, not so much in the die but on the bolt or stud used to draw the punch through the material being cut. The present invention addresses this problem as well as others associated with slug-splitting punches, among them the amount of force necessary to draw the punch through the metal. Drawing force is usually not a problem when a hydraulic driver is used but experience teaches that not all tradespeople are equipped with such a driver so they have to make do with wrenches. When using a wrench to draw the punch, the amount of force needed is an important consideration.

SUMMARY OF THE INVENTION

This invention concerns a draw punch for cutting or enlarging holes in relatively thin gauge material such as sheet metal. The draw punch of the present invention splits the slug into two pieces for easy removal from the cooperating die. The punch has a cylindrical body having a base end and a working end and a central bore through the body. The working end of the body has a circumferential cutting edge at the outside diameter of the body. A working face is defined between the cutting edge and the bore. The entire working face is radially relieved from a plane intersecting any point on the cutting edge and normal to the axis of the body. The working face extends circumferentially in a helix in symmetrical pairs of primary and secondary surfaces. This construction is preferably made by casting the punch working faces rather than grinding them as has been done in the past.

The relieved, helical working face of the present invention provides a draw punch which has a positive cutting angle for the entire cut. The positive cutting angle shears rather than tears the material, thus providing a clean, burr-free hole. The helical working face results in forces which are more consistent throughout the cutting process. The dual helix arrangement allows for reduced initial penetration force. A preferred embodiment of the punch has offset valleys which can be used to resist binding of a slug on the draw stud.

BRIEF DESCRIPTION OF THE DRAWINGS

FIG. 1 is a perspective view of one form of the draw punch of the present invention.

FIG. 2 is a top plan view of the punch.

FIG. 3 is a rear elevation view of the punch.

FIG. 4 is a front elevation view of the punch.

FIG. 5 is a side elevation view of the punch as seen from the left side of FIG. 2.

FIG. 6 is a side elevation view of the punch as seen from the right side of FIG. 2.

FIG. 7 is a section taken along line 7—7 of FIG. 2.

DETAILED DESCRIPTION OF THE INVENTION

Figure 8:
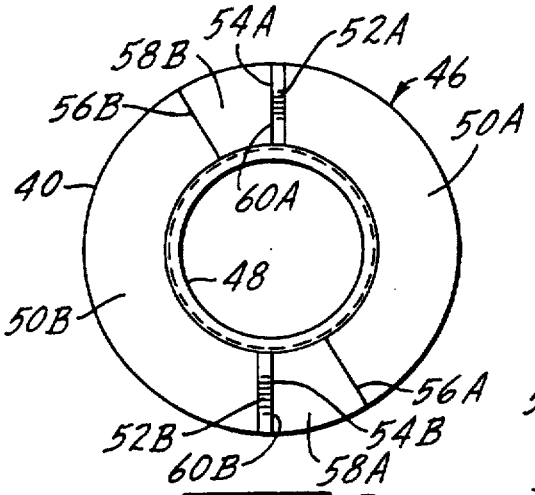
FIG. 8 is a top plan view of another embodiment of the punch having offset valleys.

FIG. 1 illustrates the draw punch of the present invention. The punch has a cylindrical body 10 having a flat base end 12 and a working end opposite the base end that will contact the material being cut. The base end and working end are joined by a generally cylindrical outside wall 14 which may be beveled as at 16 to form a portion 18 of reduced diameter. The wall 14 terminates at the base end 12 and at a circumferential cutting edge 20. There is a central bore 22 through the body that preferably will have threads on its surface for attaching the punch to a bolt or stud. A working face is defined between the cutting edge 20 and the bore 22.

Details of the working face will be described in conjunction with FIGS. 2–7. For purposes of orientation herein the base 12 will be considered the bottom or low end of the punch while the working face will be considered a top or upper end, as perhaps best observed in FIG. 4. References to an upward or downward direction will be understood to refer to a general axial direction away from or toward the base, respectively. The working face has two complementary halves which are generally identical, although rotated 180° from one another. Specific reference to an element in one half that has a corresponding element in the other half will be made with a letter designation A or B while a general reference to an element, not intended to be specific to one half or the other, will not include a letter designation. Only one working face half will be described in detail, it being understood that the other half is similar.

The working face has a primary surface 24A that starts at its uppermost end at a radial peak 26A. The peak 26A is defined at the top edge of an axial face 28A. From the peak the primary surface 24A sweeps through a segment of the body's circumference. The primary surface sweeps downwardly from the peak in a helix that terminates at a valley 30A. The sides of the primary surface 24A are bounded by a portion 20-1A of the cutting edge 20 and an arc 22-1A of the bore 22. A secondary surface 32A ascends from the valley 30A, sweeping upwardly in a helix to a root 34B of an axial face 28B. The secondary surface is bounded on its outside and inside diameters by cutting edge portion 20-2A and bore arc 22-2A.

It is emphasized that each working face half has primary and secondary surfaces 24 and 32 which are in the shape of a helix. By way of description without limitation, the helix angle of primary surface 24 at the cutting edge 20 is about 20° and the helix angle of secondary surface 32 at the cutting edge is about 10°. The helix angles may vary somewhat depending on the diameter of the punch. The helical shape of the surfaces makes the drawing force consistent as the punch is drawn through the material.

In addition to the helical shape in a circumferential direction, the primary and secondary surfaces 24 and 32 are relieved in a radial direction from the cutting edge 20 to the bore 22. This relief is present throughout the entire circumference of the punch. By relieved it is meant that the surface slopes downwardly from the cutting edge to the bore on any radius. Thus, in any given radial plane, the cutting edge is higher than the inside diameter of the surface at the bore. This can be seen in FIG. 5 where peak 26A is shown at an angle e with respect to reference line x. Reference line x represents a plane normal to the axis of the body and intersecting a point on the cutting edge. Due to the relief no other point of the face in that radial plane will intersect the normal plane. The relief angle shown is 12°. While this relief angle has been found to produce the desired results, other angles could be used.

Radial relief of the working face produces a positive cutting angle. The cutting angle is the angle between a line in the side wall parallel to the axis and a radial line parallel to the working surface. An example is the angle β between the peak 26A and the side wall 14 in FIG. 6. The reference to this angle as positive is borrowed from cutting tool technology where an angle of less than 90° is called positive. It can be seen that angle β is less than 90°. The use of a positive cutting angle throughout the entire working face produces a clean, burr-free hole, even in thin gauge material. Prior art punches having planar, ground working surfaces have cutting angles that vary from positive to negative (i.e., greater than 90° ) from one side of the punch to the other, making them prone to burr production.

The use, operation and function of the punch are as follows. The punch of the present invention is drawn into a cooperating die using a bolt and nut, such as shown in U.S. Pat. No. 2,237,069. With the punch on one side of the material, the die on the other and the bolt extending through a previously-formed pilot hole into engagement with the punch, the working face of the punch will cut through the material when the bolt and nut draw the punch and die together.

The punch is designed so that the radial peaks 26 and cutting edges 20-1 begin cutting simultaneously when the punch first penetrates the material. At first penetration the cutting edges 20-2 are not engaged with the material. As cutting continues the peaks 26 will conclude their cuts and, at approximately the time of this conclusion, cutting edges 20-2 become engaged and start cutting their portion of the periphery. Thus, the cutting force that had been needed to draw the peaks through the material is smoothly transferred to drawing the cutting edges 20-2 through the material. Moreover, cutting edges 20-2 and peaks 26 are designed to require similar forces to one another. Since the helical shape of cutting edges 20-1 generates consistent forces as they cut and cutting edges 20-2 engage about when peaks 26 disengage with a similar force requirement, the required force throughout the entire cutting process is held nearly constant. Furthermore, since the energy required to punch a hole is constant regardless of punch design, the punch of the present invention minimizes the peak force requirement.

Figure 9:
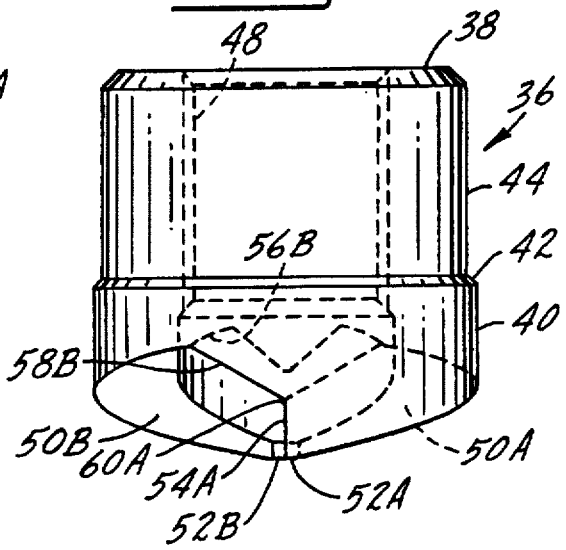
FIG. 9 is a rear elevation view of the punch of FIG. 8.
Figure 10:
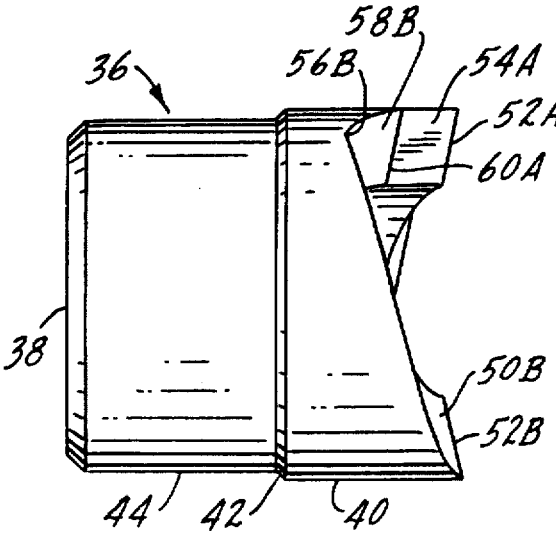
FIG. 10 is a side elevation view of the punch as seen from the left side of FIG. 8.
Figure 11:
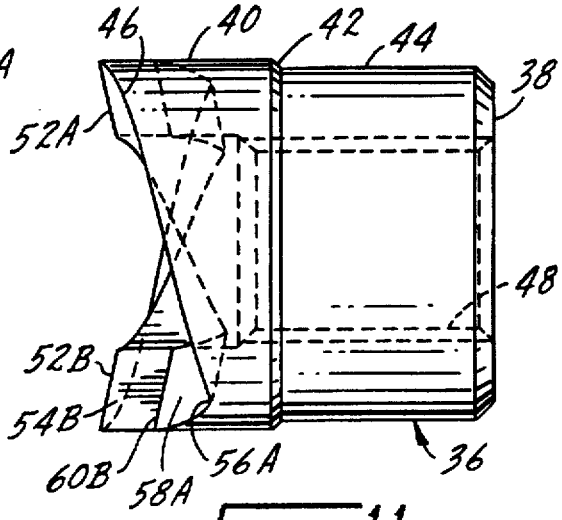
FIG. 11 is a side elevation view of the punch as seen from the right side of FIG. 8.

It has been found in previous designs that the slug will sometime bind on the bolt if the C-shaped slug is bent about its centerline. The embodiment of FIGS. 8–11 addresses this problem by offsetting the valleys from the halfway point between the peaks. In other words, the valleys are located at other than 90° to the peaks. In this embodiment the valleys are located at about 30° to the closest peak. With this arrangement the resulting slug is not bent in half and it will have a reduced tendency to bind on the bolt. From this standpoint a punch having offset valleys is a preferred embodiment. The working face of the punch has halves with primary and secondary helical surfaces, as in the previous embodiment. And the helical surfaces are radially relieved as described above.

Looking at FIGS. 8–11 in detail, the punch has a cylindrical body 36 with a base end 38 and an outside wall 40 beveled at 42 to form a reduced diameter portion 44. A circumferential cutting edge 46 is defined at the top of the wall 40. Bore 48 extends through the center of the body. A working face resides between the cutting edge 46 and bore 48. Describing a half of the working face, there is a primary helical surface 50A extending about 150° from a peak 52A of axial face 54A to a valley 56A. Secondary helical surface 58A sweeps upwardly at an angle from valley 56A to root 60B. Both surfaces 50A and 58A are radially relieved at about a 12° angle. By way of example, the helix angle of primary surface 50 at the cutting edge 46 is about 15° and the helix angle of secondary surface 58 at the cutting edge is about 30°.

It will be understood that the helix angles recited in the above two embodiments are exemplary only and the invention is not limited to the specific helix angles shown. The helix angle depends in part on the location of the valleys relative to the peaks. Generally speaking the smaller the arc between a peak and a valley, the greater the helix angle needs to be.

So far as the inventor is aware, the working face of prior art punches has been made by grinding the face on a cylindrical body. The limitations of the grinding process have dictated working surfaces that are planar or flat across the working end of the body. This is what leads to variations in the cutting angle from positive to negative. It also means the working faces are not relieved. To achieve the configuration of the present invention, it was found necessary to abandon the conventional grinding method of making a working face. The punch of the present invention is instead made of cast steel with the basic shape of the helical working surfaces cast into the body. The casting includes the center hole or bore 22. Then the piece is turned or otherwise machined to make it round. Threads are cut into the surface of the bore. The peaks 26 are formed during the turning process. Heat treating and optional black oxide finishing complete the preferred manufacturing process. Those skilled in the art will understand that these steps need not be performed in exactly the stated order and that alternative operations may be substituted for some of the steps once the basic steel casting has been obtained. It would also be possible to machine the working face in some manner, such as milling, so that a casting would not be required but using the casting is the preferred method.

While a preferred form of the invention has been shown and described, it will be realized that alterations and modifications may be made thereto without departing from the scope of the following claims.

We claim:

1. A draw punch for cutting holes in various materials, comprising a cylindrical body having a base end and a working end and a central bore extending axially through the body, the working end of the body having a circumferential cutting edge at the outside diameter of the body and a working face defined between the cutting edge and the bore, the working face extending circumferentially for substantially the entire circumference of the body and sloping downwardly toward the base end from the cutting edge to the central bore in all radial planes intersecting the axis of the bore, the working face further including first and second axial faces which are disposed generally on the same diameter and extend across the working face from the cutting edge to the bore and axially from a root to a peak, the root being the portion of the axial face closest to the base end of the body while the peak is the portion of the axial face which is the greatest axial distance from the base end of the body, and wherein a portion of the working face extending from the peak of the first axial face to the root of the second axial face comprises primary and secondary surfaces, the primary surface sweeping downwardly toward the base end from said peak to a valley intermediate said peak and said root, the secondary surface sweeping upwardly from the valley to said root.

2. The draw punch of claim 1 wherein the primary and secondary surfaces each extend circumferentially in the shape of a helix for at least a portion of the circumference of the body.

3. The draw punch of claim 1 wherein the valley is approximately midway between the peak and root.

4. The draw punch of claim 1 wherein the valley is offset from the midway point between the peak and root.

5. A draw punch for cutting holes in various materials, comprising a cylindrical body having a base end and a working end and a central bore extending axially through the body, the working end of the body having a circumferential cutting edge at the outside diameter of the body and a working face defined between the cutting edge and the bore, the working face extending circumferentially for substantially the entire circumference of the body and sloping downwardly toward the base end from the cutting edge to the central bore in all radial planes intersecting the axis of the bore and, wherein the working face includes at least first and second axial faces each extending radially across the working face from the cutting edge to the bore and axially from a root to a peak, the root being the portion of each axial face closest to the base end of the body while the peak is the portion of each axial face which is the greatest axial distance from the base end of the body, and wherein each portion of the working face extending from the peak of one axial face to the root of the other axial face comprises primary and secondary surfaces, the primary surface sweeping downwardly toward the end base from the peak to a valley intermediate the peak and root, the secondary surface sweeping upwardly from the valley to the root.

6. The draw punch of claim 5 wherein the primary and secondary surfaces each extend circumferentially in the shape of a helix for at least a portion of the circumference of the body.

7. The draw punch of claim 5 wherein the valleys are approximately midway between the corresponding peak and root.

8. The draw punch of claim 5 wherein the valleys are offset from the midway point between the corresponding peak and root.

9. A draw punch for cutting holes in various materials, comprising a cylindrical body having a base end and a working end joined by an outside wall and a central bore extending axially through the body, the working end of the body having a circumferential cutting edge at the outside diameter of the body and a working face defined between the cutting edge and the bore, the working face extending circumferentially for substantially the entire circumference of the body including at least one working face portion extending helically for at least a portion of the circumference of the body, and throughout the entire circumference of the body the angle between a line in the outside wall parallel to the axis and a radial line parallel to the working face is less than 90°, the working face further including first and second axial faces which are disposed generally on the same diameter and extend across the working face from the cutting edge to the bore and axially from a root to a peak, the root being the portion of the axial face closest to the base end of the body while the peak is the portion of the axial face which is the greatest axial distance from the base end of the body, and wherein one working face portion extends from the peak of the first axial face to the root of the second axial face and comprises primary and secondary surfaces, the primary surface sweeping downwardly toward the base end from said peak to a valley intermediate said peak and said root, the secondary surface sweeping upwardly from the valley to said root.

10. The draw punch of claim 9 wherein the primary and secondary surfaces each extend circumferentially in the shape of a helix for at least a portion of the circumference of the body.

11. The draw punch of claim 9 wherein the valley is approximately midway between the peak and root.

12. The draw punch of claim 9 wherein the valley is offset from the midway point between the peak and root.

13. A draw punch for cutting holes in various materials, comprising a cylindrical body having a base end and a working end joined by and outside wall and a central bore extending axially through the body, the working end of the body having a circumferential cutting edge at the outside diameter of the body and a working face defined between the cutting edge and the bore, the working face extending circumferentially for substantially the entire circumference of the body and including at least one working face portion extending helically for at least a portion of the circumference of the body, and throughout the entire circumference of the body the angle between a line in the outside wall parallel to the axis and a radial line parallel to the working face is less than 90°, and wherein the working face includes at least first and second axial faces each extending radially across the working face from the cutting edge to the bore and axially from a root to a peak, the root being the portion of each axial face closest to the base end of the body while the peak is the portion of each axial face which is the greatest axial distance from the base end of the body, and wherein each working face portion extends from the peak of one axial face to the root of the other axial face and comprises primary and secondary surfaces, the primary surface sweeping downwardly toward the base end from the peak to a valley intermediate the peak and root, the secondary surface sweeping upwardly from the valley to the root.

14. The draw punch of claim 13 wherein the primary and secondary surfaces each extend circumferentially in the shape of a helix for their entire extent.

15. The draw punch of claim 13 wherein the valleys are approximately midway between the corresponding peak and root.

16. The draw punch of claim 13 wherein the valleys are offset from the midway point between the corresponding peak and root.

* * * * *